US011255099B2

(12) United States Patent
Towfighi

(10) Patent No.: US 11,255,099 B2
(45) Date of Patent: Feb. 22, 2022

(54) STEEL PLATE DAMPER FOR STRUCTURES SUBJECT TO DYNAMIC LOADING

(71) Applicant: Saeed Towfighi, Gatineau (CA)

(72) Inventor: Saeed Towfighi, Gatineau (CA)

( * ) Notice: Subject to any disclaimer, the term of this patent is extended or adjusted under 35 U.S.C. 154(b) by 29 days.

(21) Appl. No.: 16/853,163

(22) Filed: Apr. 20, 2020

(65) Prior Publication Data

US 2021/0324651 A1 Oct. 21, 2021

(51) Int. Cl.
*E04H 9/02* (2006.01)
*E04B 1/98* (2006.01)

(52) U.S. Cl.
CPC ..... *E04H 9/0237* (2020.05); *E04B 1/98* (2013.01)

(58) Field of Classification Search
USPC ..... 52/167.4, 167.7, 167.8
See application file for complete search history.

(56) References Cited

U.S. PATENT DOCUMENTS 5,509,238 A * 4/1996 Scalfati ..... E04H 9/021 52/167.4
5,862,638 A * 1/1999 Holland ..... E04H 9/022 52/167.8
2006/0272226 A1* 12/2006 Robinson ..... E02D 27/34 52/167.4
2013/0104467 A1* 5/2013 Yamao ..... E04B 1/98 52/167.4
2017/0261129 A1* 9/2017 Duggan ..... E02D 27/34
2018/0216687 A1* 8/2018 Thompson ..... F16F 15/085
2018/0334825 A1* 11/2018 Bonessio ..... E04H 9/022

* cited by examiner

*Primary Examiner* — Joshua K Ihezie
(74) *Attorney, Agent, or Firm* — Arjomand Law Group; Ata Arjomand

(57) ABSTRACT

Method, apparatus, and systems are disclosed for damping the movements of structures undergoing dynamic forces. The disclosed dampers are a new type of steel plate dampers, intended to reduce the cost and improve the performance of structures subject to severe seismic loading. While in these dampers the metal plates undergo plastic deformation as a method of absorbing and dissipating energy, the disclosed designs do not allow the stress and strain in the metal plates to go above a predetermined design value and; therefore, the new dampers have long lives and do not need repair or replacement after a big earthquake or similar events. These dampers may be used for building and non-building structures. In such applications the required damping capacities are relatively high and different scales of sliding force and stroke are required.

15 Claims, 11 Drawing Sheets

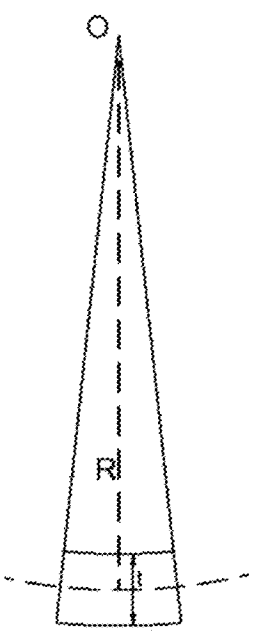
Fig. 6A
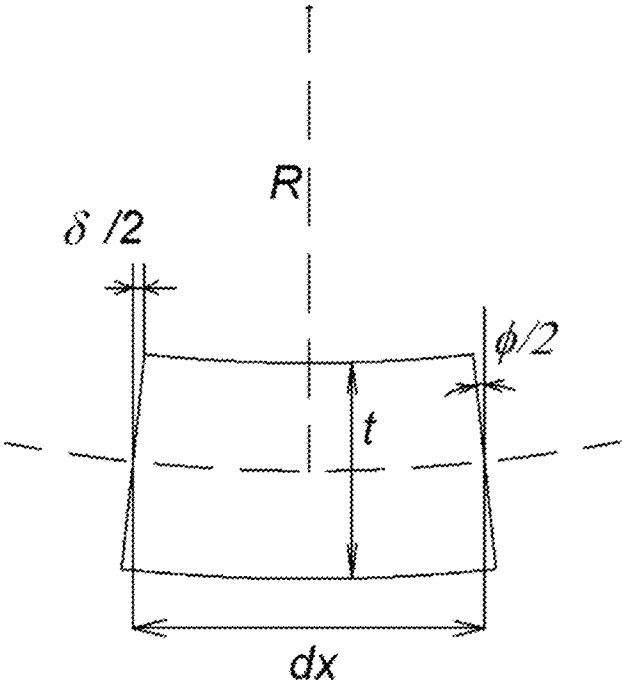
Fig. 6B
$$\phi = dx / R$$
$$\varepsilon = \delta / dx$$
$$\phi / 2 \,.\, t / 2 = \delta / 2$$
$$\varepsilon = t / (2 R)$$
Fig. 6C

STEEL PLATE DAMPER FOR STRUCTURES SUBJECT TO DYNAMIC LOADING

CROSS-REFERENCE(S) TO RELATED APPLICATION(S)

This application claims the benefit of the filing date of the U.S. Provisional Patent Application 62/836,648, entitled "DEVICE FOR ENERGY DISSIPATION UNDER DYNAMIC LOADING," filed on 20 Apr. 2019, under 35 U.S.C. § 119, the specifications of which is incorporated herein in its entirety by reference.

TECHNICAL FIELD

This application relates generally to the field of energy absorption. More specifically, this application relates to methods, apparatus, and systems for absorbing and dissipating energy of structures subject to dynamic loading.

BRIEF DESCRIPTION OF THE DRAWINGS

The drawings, when considered in connection with the following description, are presented for the purpose of facilitating an understanding of the subject matter sought to be protected.

FIG. 6A shows a small segment of a cylindrical plate about center point O. This segment represents cross section of a small length of a leg of the curved portion of a U-plate that was flat before wrapping it around a cylinder;

FIG. 6B shows a deformed shape of the segment of FIG. 6A with geometrical parameters;

FIG. 6C shows the classical calculations of strain in segment of FIG. 6A;

DETAILED DESCRIPTION

Figure 1A:
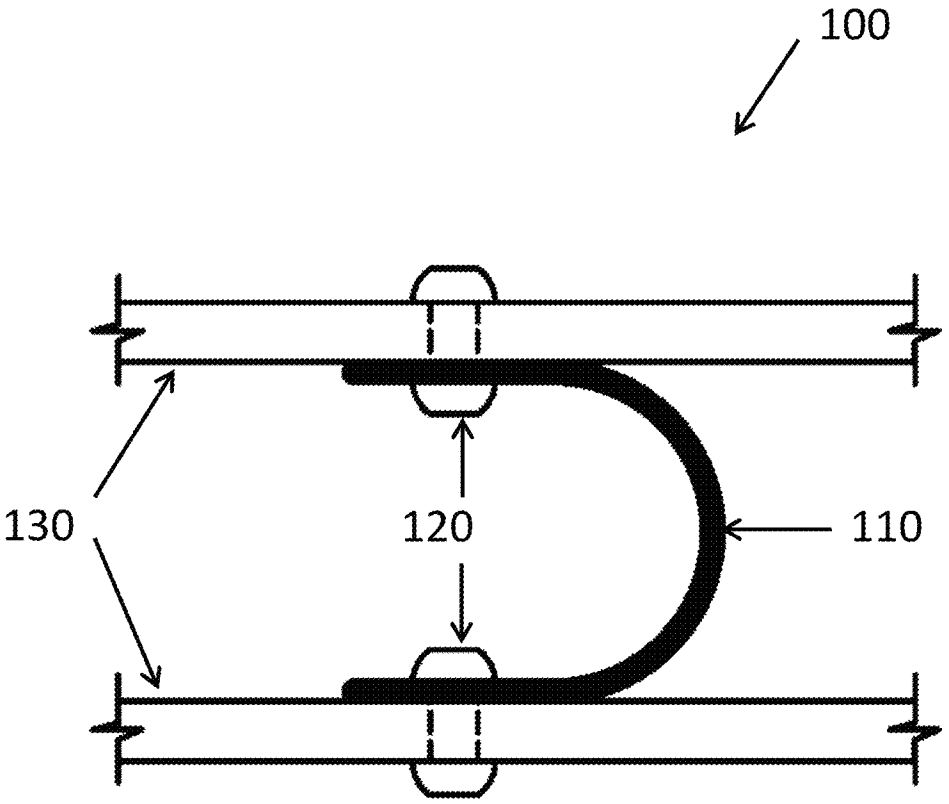
FIG. 1A schematically illustrates a cross-sectional view of a traditional and customary U-plate damper while at rest.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references using a small number of steel plates and rollers and a few different methods of attachment of steel plates to each other, it will be appreciated that the disclosure may include fewer or more plates, rollers, and components of different materials and other methods of joining the plates together.

Building codes for buildings, whether residential or commercial, have a minimum set of standards designed to allow the building to withstand dynamic forces such as wind and earthquake and other natural and/or man-made phenomena. When an earthquake or similar event occurs, energy from the earthquake is transferred to the structure, causing the structure to oscillate, therefore causing the structure and its members to undergo a number of excursions causing tensile and compressive forces in its members. In such an energy-inducing event if the building codes are adhered to and the energy-inducing event is of a size less than the maximum for which the building codes were designed, the structure can withstand the tensile and compressive stresses without excessive deformation.

Often to meet the building codes, a frame-based structure is designed and constructed with stiff cross-members (braces) to withstand compressive and tensile forces occurring as a result of displacement. Typically, building code standards require structures to exhibit high-energy dissipating characteristics that would allow for multiple cycles of non-linear displacement. However, those forces that may cause a structure to undergo non-linear displacement, may cause significant damage to the structure despite compliance with the building codes. Such structures are susceptible to deformation in the event of a large earthquake or similar event which causes non-linear displacement and stress cycles above and beyond the elastic stresses of the building materials.

In cities such as Los Angeles and San Francisco, to prevent or reduce the damage in the event of a major seismic event, structural dampers may be used which absorb high amounts of energy generated by the seismic event. In general "Dampers" are devices which allow the effects generated by forces of a dynamic nature to be reduced on structures and to prevent resonance or store of energy in the structure. Exemplary structural dampers include various fluid-based and visco-elastic dampers. Such damping structures are specialized and expensive and are typically limited to high-cost applications that require high-performance capabilities.

Currently there are several types of devices for dissipating energy from structures or mechanical systems. Those mainly consist of viscous dampers, friction dampers, buckling restrained braces (BRB) and steel plate dampers. Accordingly, there is a need for low-cost structural dampers that can absorb significant amount of energy to reduce displacement and damage to structures. There is also a need for structural damping apparatus and systems that can be utilized in new constructions or can be efficiently installed to retrofit and rehabilitate existing structures. Moreover, such dampers may be used for many different applications in addition to seismic activities and can, for example, dissipate energy transferred to structures through wind, explosive blasts, and other similar events.

The number of structures with dampers, in comparison with conventional structures, is small due to the high cost of available products on the market, concerns about reliability of the damping mechanisms, or usage requirements that are beyond characteristics of a certain damper type. Viscous dampers that transform mechanical energy into heat do not add to the stiffness of the structure and often, in comparison with no-damper solutions, are not cost effective. Friction dampers are less expensive however rely on compressive force between parts of the damper and coefficient of friction that both may change by passage of time and due to atmospheric causes, making them less reliable. Tapered steel plate dampers that dissipate energy through bending are difficult to work with because strain in plates is directly related to the stroke which is not desirable. Buckling restrained braces are the least desirable; elongation of the elastic segment of the steel confined in cementitious material is wasteful and their cumulative strain energy absorption can be insufficient under large strokes. Moreover, BRBs are heavy and difficult to carry and install despite being less expensive than friction or viscous dampers.

Dampers based on the plastic deformation of U-shape steel plates have been around for a number of years but the stress concentration in the plates, which seriously limits their useful life, and the large size of dampers made of these plates make it impractical to use these dampers in building structures. The disclosed apparatus and systems solve the problems of the U-shape plate dampers and make them a viable solution for structures subject to high dynamic forces. The claimed apparatus is a new type of steel plate damper that reduces the cost and noticeably improves the performance of structures subject to seismic loading when compared with other dampers and particularly with other steel plate dampers on the market. This new damper can be used for seismic mitigation of buildings and non-building structures. In such applications required damping capacities are relatively high and different levels of sliding force and stroke are required. This device is basically made of a few steel plates, rollers, and fasteners, and because of its low cost and high performance, it can expand the use of dampers in buildings.

Suitability of a plate damper depends on the range of activation forces, range of strokes and the number of cycles that a damper can take. Strong earthquakes or winds that buildings may experience during their lifetime are not frequent but magnitude of forces and the range of strokes can be relatively large. A traditional damper made from a U-shape steel plate, hereinafter called "U-plate damper," has a limited usage because it undergoes strain concentrations that severely limits the number of deformation cycles that the plates can withstand. These traditional U-plate dampers may require replacement after a strong earthquake. However, they are relatively inexpensive to make and their underlying mechanism is reliable as it does not include friction or abrasion and it only relies on plastic deformation of the steel plates.

FIG. 1A schematically illustrates a cross-section of a traditional and customary U-plate damper 100 in its default position. As seen in FIG. 1A, a U-shape steel plate 110 is permanently and fixedly attached to two plates 130 by two fasteners 120. In FIG. 1A, the U-plate damper 100 is at rest and the structure to which it is attached has not been subjected to any dynamic forces.

Figure 1B:
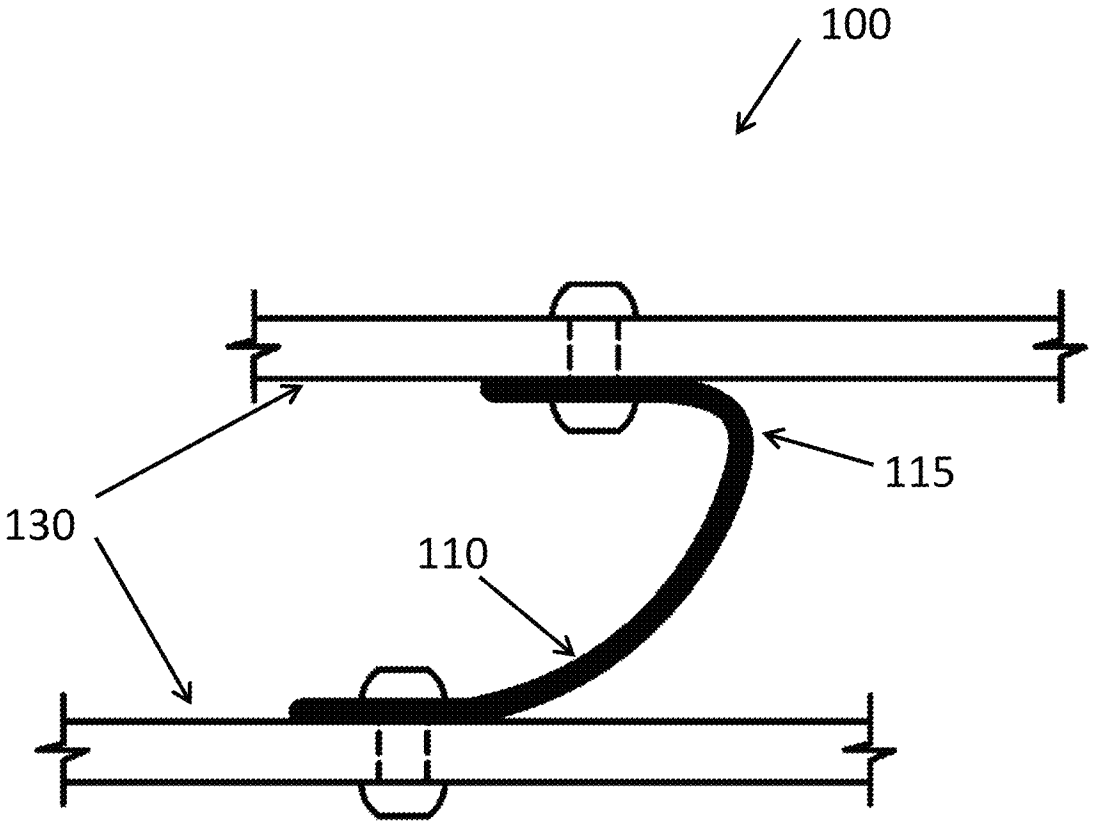
FIG. 1B schematically illustrates a cross-sectional view of the U-plate damper of FIG. 1A after exertion of a dynamic force to the structure to which the U-plate damper is attached.

FIG. 1B shows the same U-plate damper of FIG. 1A after exertion of a force to the structure to which the U-plate damper 100 is attached and after the structure has undergone permanent or temporary deformation. As seen from FIG. 1B, and as a result of this force, the upper plate 130 has moved relative to the lower plate 130, causing the curvatures of the deformed U-plate 110 to change at different locations along the length of the curved part of the U-plate 110 (unsymmetrical deformation). This uneven curvature causes uneven stress and strain at different locations within the U-plate 110. As can be seen in FIG. 1B, by those skilled in the art, the maximum strain is approximately located at point 115 of U-plate 110, which will ultimately cause the premature failure of the U-plate 110.

One of the advantages of the disclosed new design is the elimination of strain concentration by forcing the U-plate to maintain the same curvature along the curved side of the U-plate. This fundamental improvement in the behavior of the U-plate dampers will increase the useful life of the dampers and will eliminate the need to repair or replace these dampers after, for example, each earthquake.

Figure 2A:
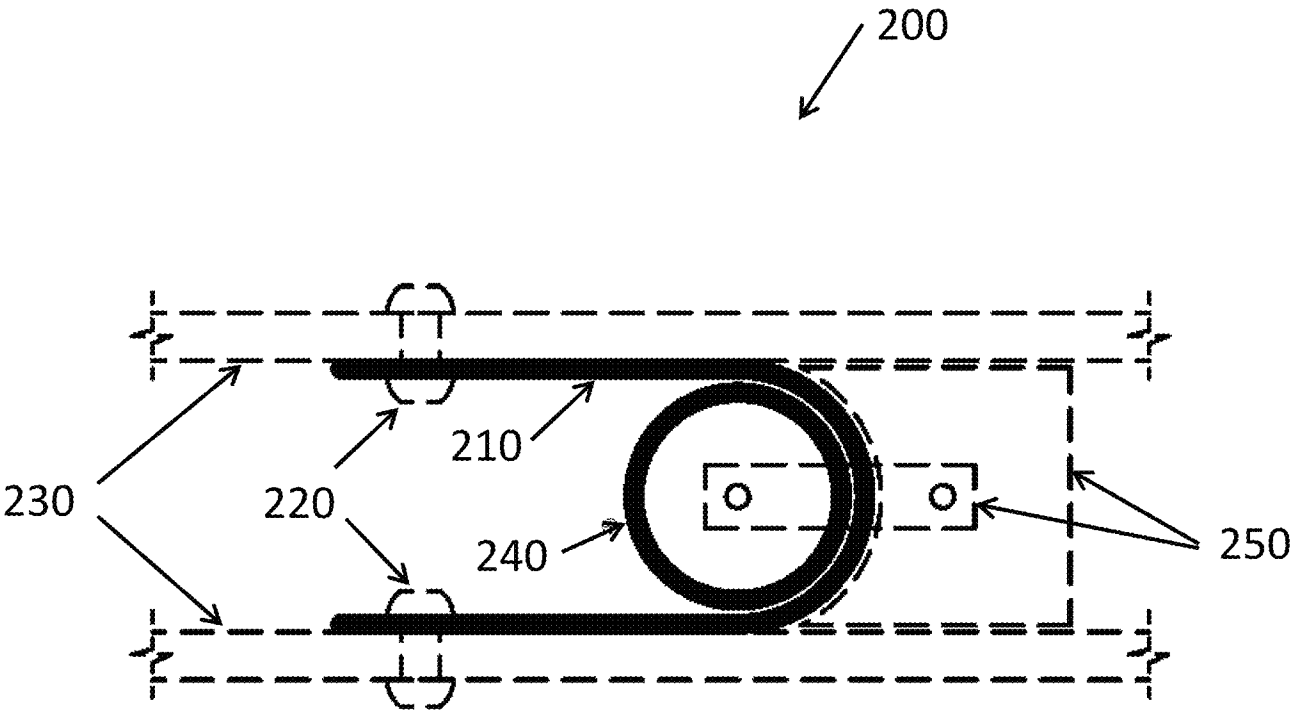
FIG. 2A schematically illustrates a cross-sectional view of an embodiment of a simple form of the disclosed U-plate damper comprising a U-shape metal plate and a cylinder that is kept at all times within the curved portion of the U-shape plate.

As shown in FIG. 2A, the simplest form of the new U-plate damper 200 is comprised of a U-shape plate 210 and a cylinder 240 that is kept at all times within the curved portion of the U-shape plate 210 and as much as possible adjacent to the plate 210. Theoretically, if the cylinder 240 is tightly sandwiched or squeezed between the two legs of the U-shape plate 210, the cylinder 240 will stay within the curved part of the U-shape plate 210 and will roll by any parallel movement of the legs with respect to each other. In such simple exemplary embodiments the dashed-line arrangement of members 250 is one possible method to keep the cylinder 240 within the curved part of the U-shape plate 210. In this fundamental configuration the first leg and the second leg of the U-shape plate 210 may be attached to two different members of a structure or may be attached to two plates 230 which themselves are attached to the members of the structure.

Figure 2B:
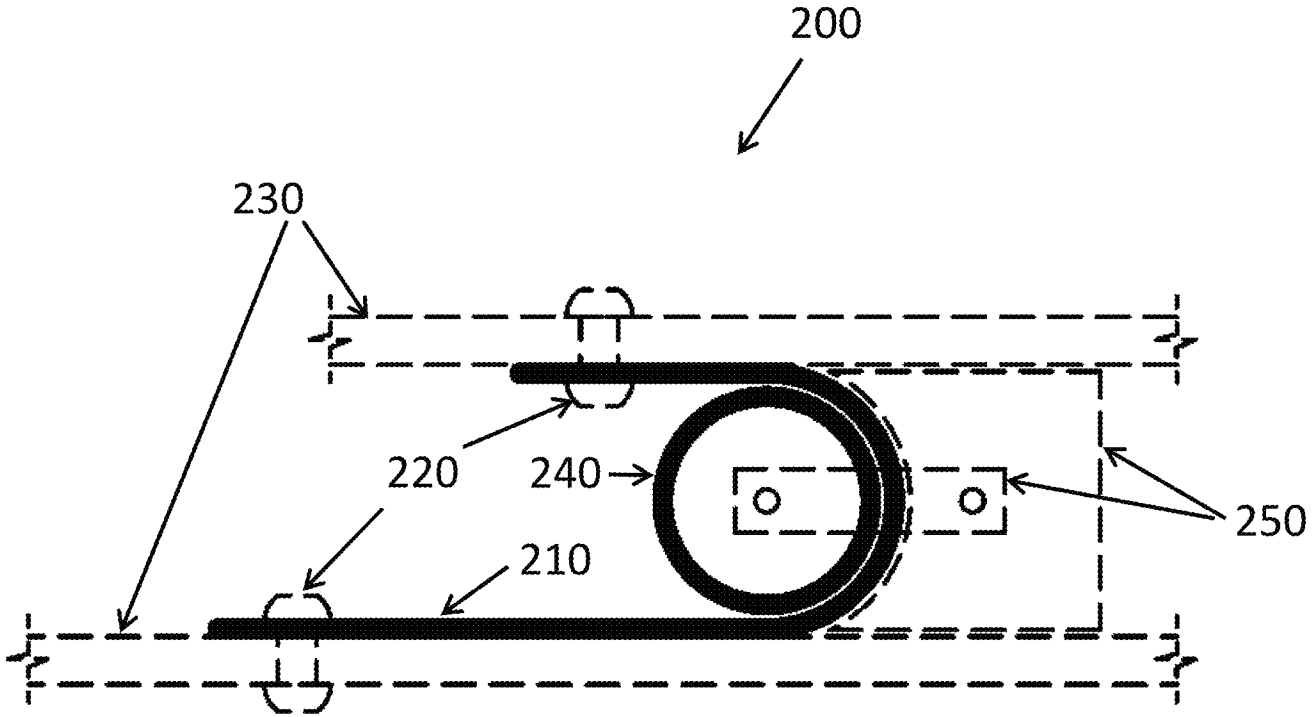
FIG. 2B schematically illustrates a cross-sectional view of the U-plate damper shown in FIG. 2A after exertion of a dynamic force to the structure to which the U-plate damper is attached.

As shown in FIG. 2B, a movement/deformation of the structure will cause a movement of the two legs of the U-shape plate 210 relative to each other, which will cause a deformation of U-shape plate 210 and absorption of some energy by damper 200 while the shape and curvature(s) of the curved portion of plate 210 will not change by this deformation. Again, as illustrated in FIG. 2B, the cylinder 240 has been kept, at all times, within the curve part of plate 210 by components 250.

As illustrated in FIGS. 2A and 2B, it is preferred to keep the points of attachments 220 of the two legs of the U-shape plate 210 as far as possible from the starting point of the curved part of the U-shape plate 210. This practice will allow the maximum range of movement of each leg of the U-shape plate 210 with respect to the other leg without creating any undesirable strain in the U-plate 210, which means that the U-plate damper 200 will remain fully functional and undamaged even during the large movements of the structure.

Figure 3:
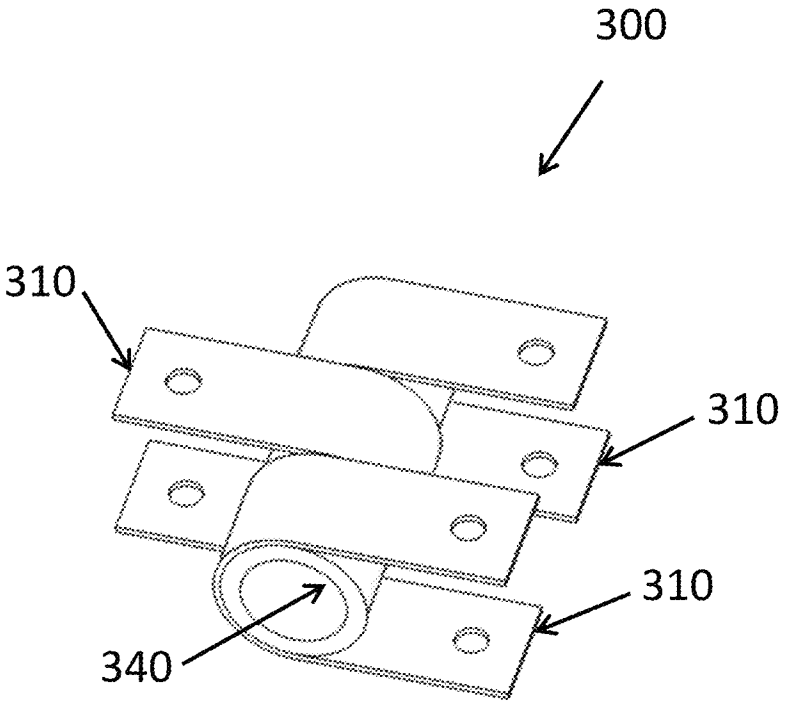
FIG. 3 is a three-dimensional rendering of an embodiment of the disclosed damper with more than one U-shape plate while keeping the cylinder within the curved portion of the U-plates at all times.

In various embodiments, to add to the number of U-shape plates 310 and to keep the cylinder 340 within the curved portion of the U-plates 310, a configuration 300 shown in FIG. 3 may be used. Please note that in some embodiments the cylinder inside the U-plates may be replaced by other shape components with substantially round cross-sections such spheres, wheels, and the like. In some embodiments even a component with hexagonal shape cross-section may be adopted to replace the cylinder. Configuration 300 of FIG. 3, in various embodiments, may become a building block for more complicated damper arrangements such as the one shown in FIGS. 4, 5 and 7. In the building block 300 if the upper legs of the U-plates 310 are attached to a first plate or a first structure member and the lower legs of the U-plates 310 are attached to a second plate or a second structure member, and when the first and the second plates or structure members move relative to each other, all three U-plates 310 will undergo deformation and energy absorption while the cylinder 340 will stay tightly within the curved sections of all three U-plates 310 and while the curvatures of the curved sections of all three U-plates 310 will remain unchanged. Attachments of the U-plate with the structure members or plates may be, for example, by rivets, screws, bolts and nuts, adhesives, or by different kinds of welding. Furthermore, these attachments may be fixed or moveable as will be discussed in the following paragraphs.

Please note that other similar arrangements with more than three U-plates can be made to keep the cylinder tightly within the curved sections of all the U-plates.

Figure 4:
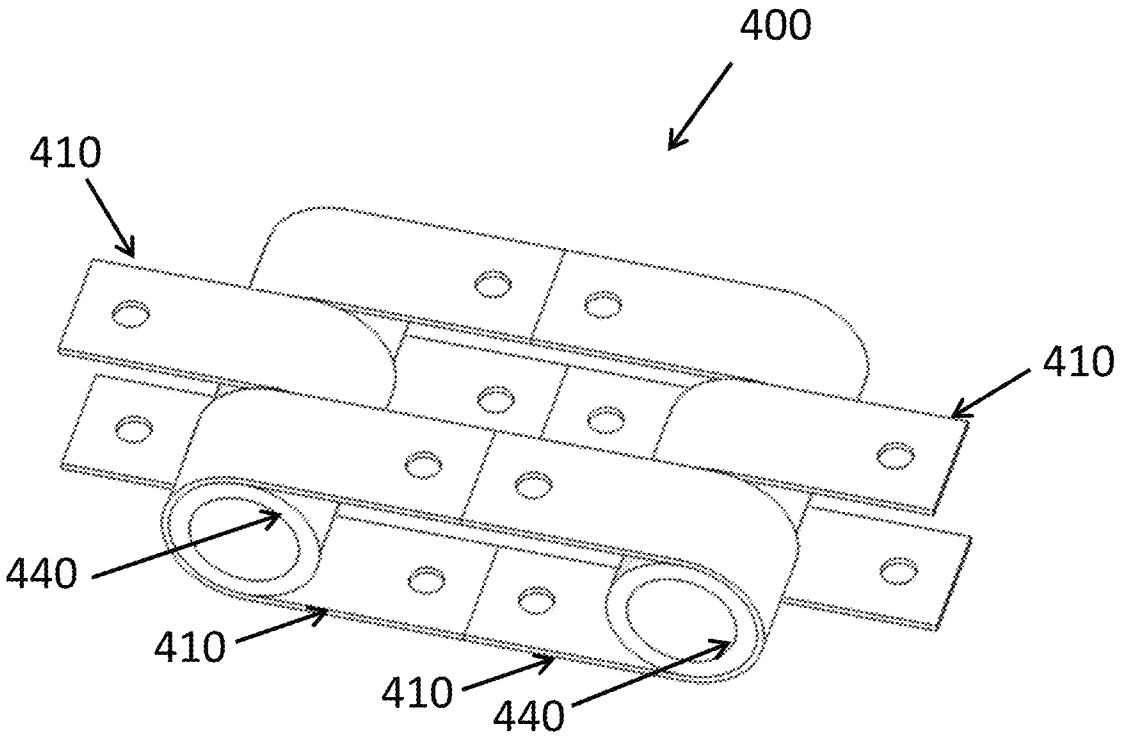
FIG. 4 shows a more complicated U-plate damper made by integrating multiple building blocks shown in FIG. 3.

FIG. 4 simply illustrates a subsystem or configuration 400 of the new design as a result of the integration of two building blocks 300 shown in FIG. 3. Such integration may be continued from both sides to add to the number of U-plates and to the sliding force of the damper while maintaining a slim configuration. In such configuration 400, all upper legs of the U-plates 410 are fixedly or moveably attached to one structure member or plate and the lower legs of the U-plates 410 are fixedly or moveably attached to another structure member or plate. If the plates or structure members move relative to each other, all U-plates 410 will undergo deformation and energy absorption while the cylinders 440 will stay tightly within the curved sections of all U-plates 410 and while the curvatures of the curved sections of all U-plates 410 will remain unchanged.

Figure 5:
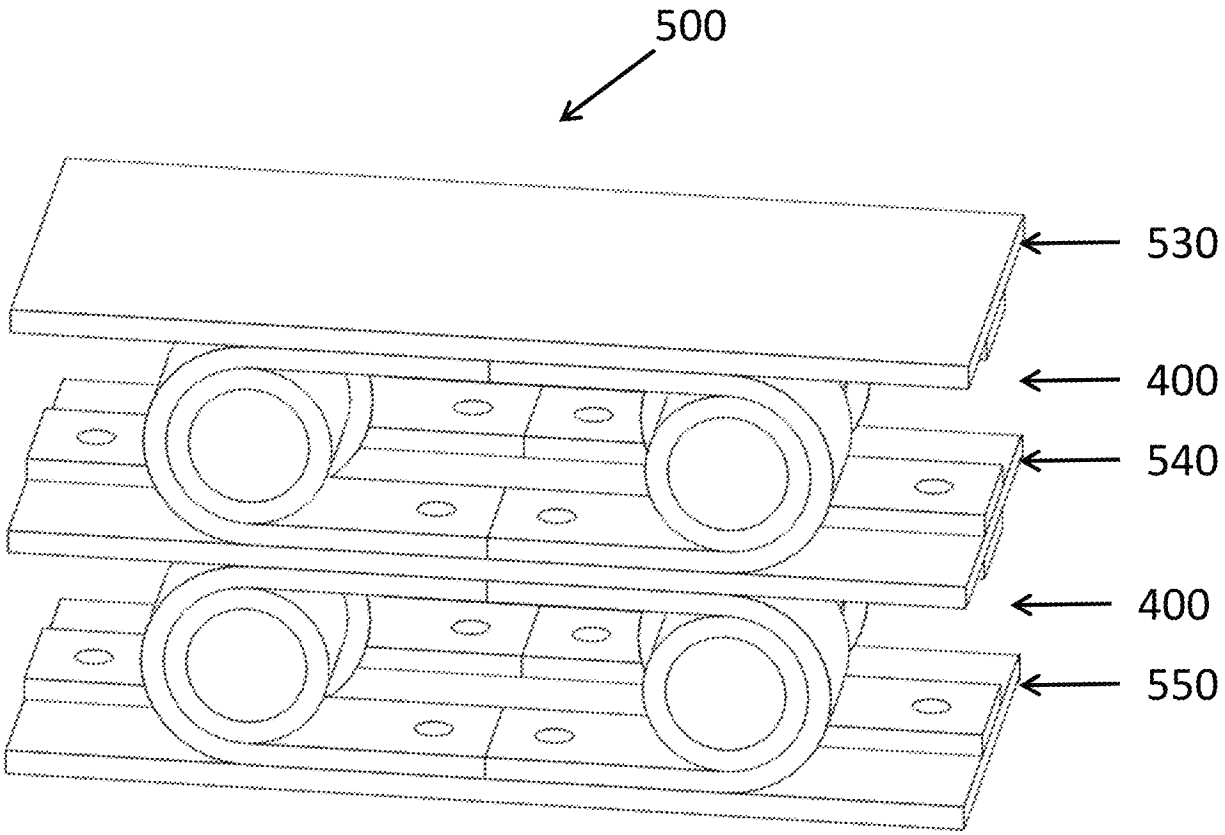
FIG. 5 illustrates another example subsystem or configuration of the new design as a result of the integration of the two subsystems illustrated in FIG. 4.

FIG. 5 illustrates another example subsystem or configuration 500 of the new design as a result of the integration of two subsystems 400, illustrated in FIG. 4. In this configuration, two subsystems 400 are sandwiched between three plates 530, 540, and 550, wherein one subsystem 400 lies between plates 530 and 540 and the other subsystem 400 lies between plates 540 and 550. In this configuration, the upper legs of the subsystem between plates 530 and 540 are attached to plate 530 and the lower legs of the subsystem between plates 540 and 550 are attached to plate 550. However, both the lower legs of the subsystem between plates 530 and 540 and the upper legs of the subsystem between plates 540 and 550 are attached to the middle plate 540. With this new subsystem 500, if plates 530 and 550 do not move with respect to each other but move relative to plate 540, all twelve U-plates of the subsystems 400 will undergo deformation and will achieve energy absorption without any detrimental stress and/or strain concentration in any of the U-plates. In configurations such as the one in FIG. 5, plates 530 and 550 can be the two opposite sides of a box that contains and partly forms the damper and which can be attached to one structure member and plate 540 can be attached to another structure member. In effect, this configuration is similar to an automobile shock absorber and is preferable to be subjected only to axial forces and be prevented from receiving any torques and moments.

In some embodiments each U-plate may be composed of multiple layers of plates to reduce maximum stress and strain in the plate material(s). Additionally, in some embodiments the plate layers forming a U-plate may be of different materials. FIG. 6A shows a small segment of a cylindrical plate about center point O. This segment represents cross section of a small length of a leg of the curved portion of a U-plate that was flat before wrapping it around a cylinder. The deformed shape of the segment with geometrical parameters is shown in FIG. 6B. Classical calculations as shown in FIG. 6C indicate that strain value "c" is equal to plate thickness "t" divided by twice of radius of curvature "R". In another word, bending a plate, the strain is directly proportional to the thickness of the U-plate. The Proposed multilayer configuration for U-plates limits maximum strain deformations according to this formula, making the damper behavior more predictable. Layers of U-plates that are closer to the cylinder will have smaller radius of curvature and can be thinner in order to limit their maximum strain and the outer plates can be thicker for the same strain limit. Usage of multilayer plates also makes the dampers more compact and eliminates the need to add to the radius of the cylinders to achieve lower strains.

Figure 7:
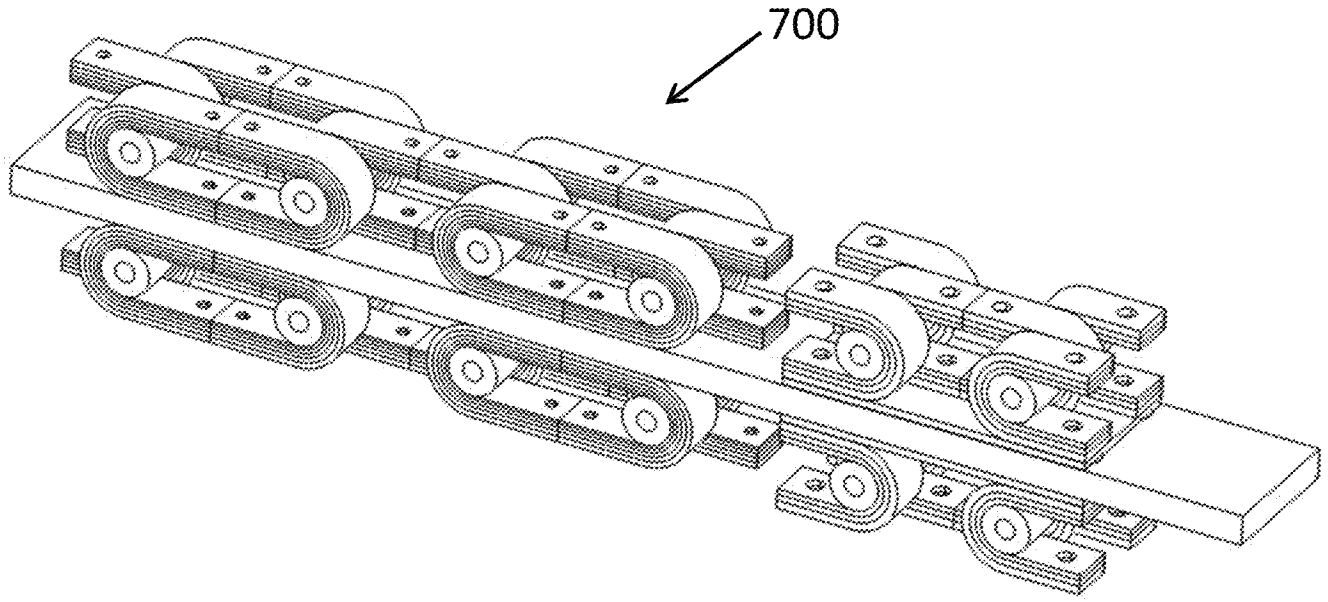
FIG. 7 illustrates a combination of several subsystems 500 shown in FIG. 5 and for clarity, the top and the bottom plates are not shown in FIG. 7.
Figure 8:
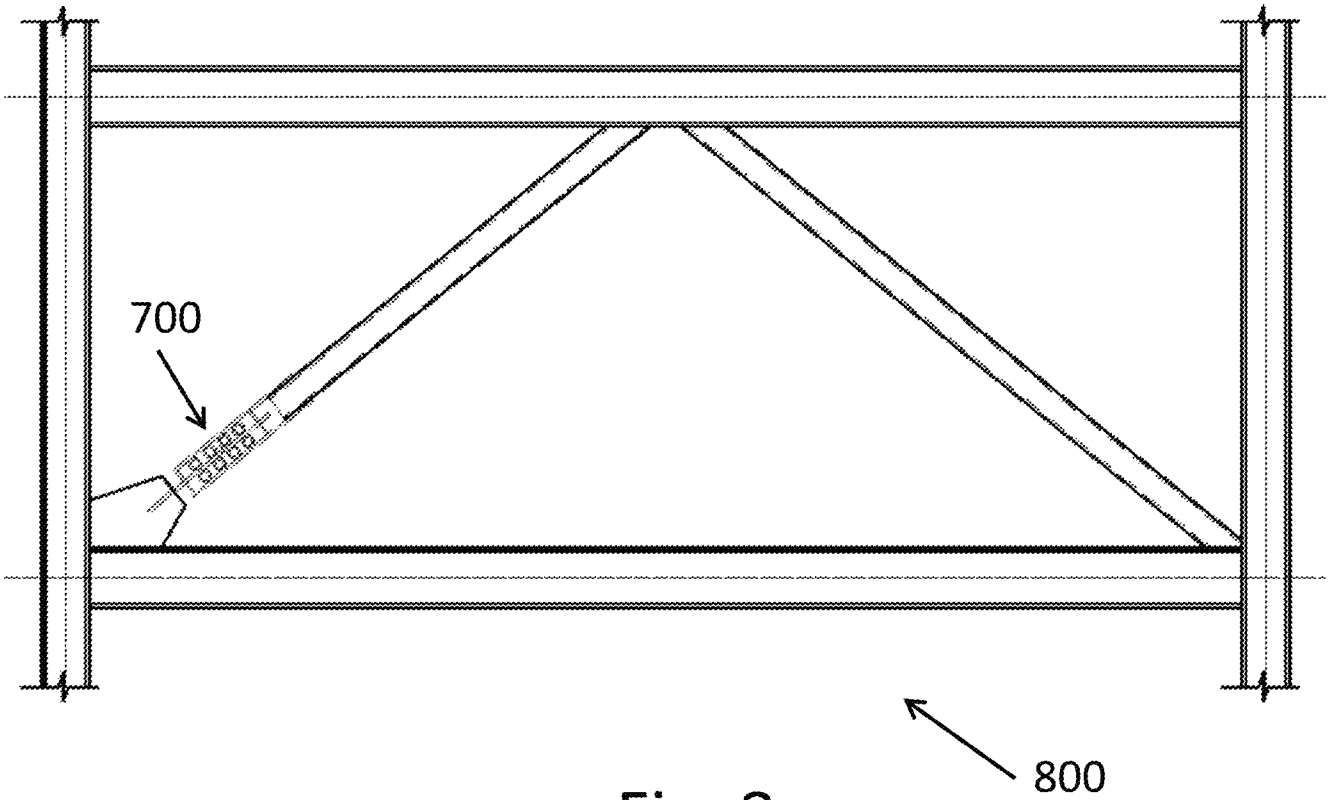
FIG. 8 shows an example use of the U-plate damper 700 in a structure 800.

FIG. 7 illustrates a combination of several subsystems 500 shown in FIG. 5. For clarity, the top and the bottom plates are not shown in FIG. 7. In this embodiment the U-plates are multilayer. This embodiment presents a viable and practical damper for most residential and commercial buildings and structures. FIG. 8 shows an example use of the U-plate damper 700 in a structure 800.

Please note that a damper may be easily made by placing any desired number of subsystem 300, in any desired formation and arrangement, between two or multiple parallel cover plates and attaching the legs of their U-plates to their adjacent cover plates, as long as the axes of all their cylinders are parallel to each other.

With the disclosed new apparatus and systems, the U-plate dampers may be made to function in different stages and respond to different intensities of dynamic forces and variable structural loading. For example, the U-plate damper 700 of FIG. 7 can be manufactured to progressively employ and engage its basic blocks or its U-plates as the magnitude of the movements of the structure to which it is attached progressively increases. Therefore a U-plate damper may be designed and manufactured to function in one, two, or multiple stages.

Figure 9:
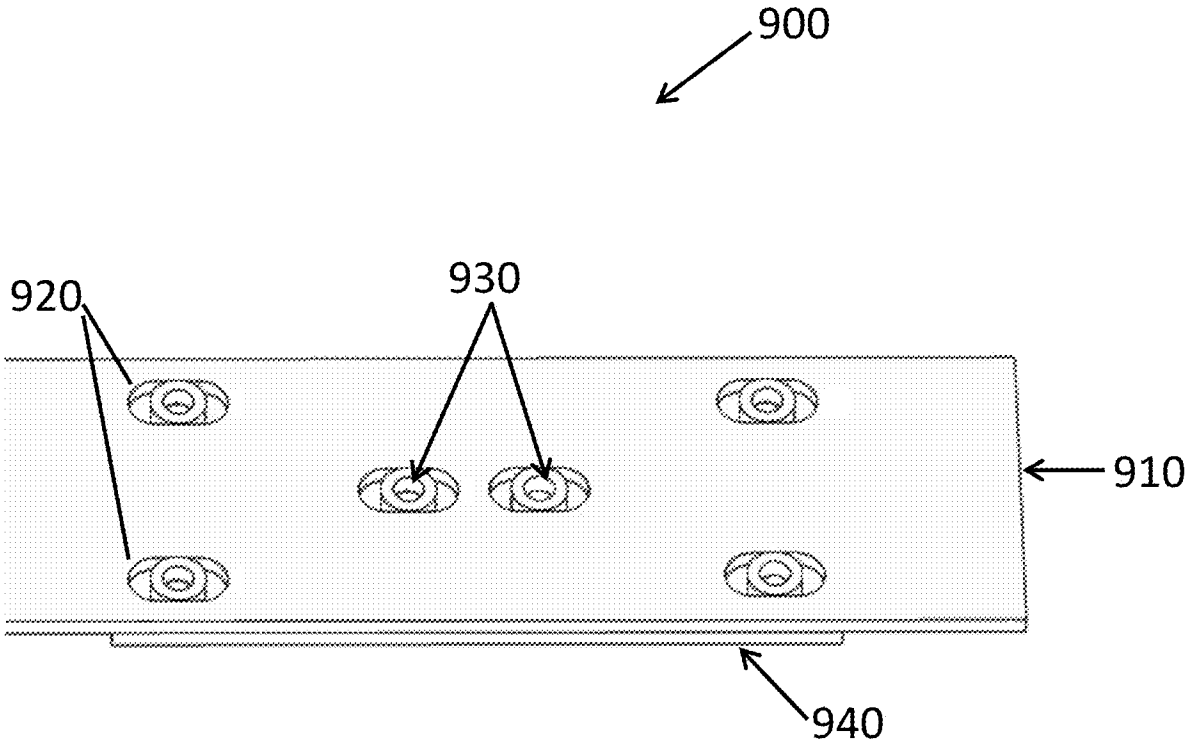
FIG. 9 illustrates an example mechanism in a U-plate damper for engaging multiple U-plats in stages.

FIG. 9 illustrates a novel method of achieving this goal. In FIG. 9, plate 910 signifies the inner plate of the subsystem 700, and plate 940 demonstrates a leg of a U-plate. As it can be seen in this figure, plate 910 has slotted holes 920 while rivets or bolts 930 are rigidly attached to plate 940 and cannot engage plate 910 unless after plate 910 or plate 940 moves some distance to the left or right. This is an example of what has been called "moveable attachment" throughout this disclosure. The longer these slots, the more relative movement it takes for plates 910 and 940 to engage. With the damper embodiment 700 of FIG. 7, the outer plates can be fixedly attached to U-plates of all the basic building blocks while the inner plate may be fixedly attached to the U-plates of some basic building blocks and moveably attached to the U-plates of other basic building blocks. Having different length slotted holes for attachment of U-plates of some basic building blocks allows engagement with these U-plates after any desired relative movement of the cover plates. In fact, for every single basic building block, the three legs of the U-plate on one side of the cylinder can be fixedly attached to one of the cover plates and the other three legs of the U-plate on the opposite side of the cylinder can be fixedly or moveably attached to the other cover plate. Accordingly, by providing different length slots for one side of different basic building blocks, the U-plates engage the damper system and start functioning in different predetermined stages. It can be seen that this new damper allows relatively large stroke values with a constant maximum strain in the plates. This is not possible with buckling restrained braces as commonly used or traditional U-plate dampers.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A U-plate damper unit comprising:

at least a first and a second and a third U-shape metal plate ("U-plate"), each including a first and a second substantially flat part connected to each other by a curved part of the U-plate, wherein the first and the second flat parts of each U-plate are parallel to each other and wherein a concave side of the curved part of each U-plate lies between the first and the second flat parts of that U-plate; and a solid or a hollow cylinder, wherein the cylinder is partially by each of the three U-plates and wherein the curved parts of two of the U-plates that are not next to each other are adjacent to same half-cylinder-surface of the solid or the hollow cylinder and the curved part of the third U-plate that lies between the other two U-plates is adjacent to opposite half-cylinder-surface of the solid or the hollow cylinder such that the three flat parts of the three U-plates are on a first plane that is tangent to one side of the cylinder and the other three flat parts of the three U-plates are on a second plane that is tangent to opposite side of the cylinder and wherein the first and the second planes are parallel and wherein a parallel movement of the flat parts, located on the first plane, relative to the other three flat parts situated on the second plane causes the three U-plates to be deformed and to absorb and dissipate energy.

2. The U-plate damper unit of claim 1, wherein flat parts of the three U-plates that are on the first plane are attached to a member of a building or a structure and the other three flat parts of the three U-plates that are situated on the second plane are attached to another member of the building or the structure for damping the building or the structure movements.

3. The U-plate damper unit of claim 1, wherein each U-plate is made of one metal layer or made of multiple layers of metal plates with equal or different thicknesses.

4. The U-plate damper unit of claim 1, wherein the three flat parts of the three U-plates that are situated on the first plane are attached to a first metal or non-metal cover plate and the three flat parts of the three U-plates that are situated on the second plane are attached to a second metal or non-metal cover plate.

5. The U-plate damper unit of claim 1, wherein multiple U-plate damper units are arranged in a line formation such that longitudinal axes of all solid or hollow cylinders are in parallel and all of the U-plate damper units share same first plane and same second plane.

6. The U-plate damper unit of claim 5, wherein all flat parts of the U-plate damper units situated on the first shared plane are attached to a first metal or non-metal cover plate and all flat parts of the U-plate damper units situated on the second shared plane are attached to a second metal or non-metal cover plate and wherein the attachments of the flat parts of the U-plate dampers to the cover plates are fixed and/or moveable.

7. The U-plate damper unit of claim 5, wherein a first line formation of multiple U-plate damper units are placed between and attached to a first and a second cover plates and a second line formation of another multiple U-plate damper units are placed between and attached to the second and a third cover plates and wherein the first and the third cover plates are attached to one member of a structure and the second cover plate is attached to another member of the structure such that a movement of the structure causes a parallel movement of the second cover plate relative to the first and the third cover plates and deforms the U-plates and wherein the attachments of the flat parts of the U-plate dampers to the cover plates are fixed and/or moveable.

8. A U-plate damper comprising:

At least two damper units, each including:

three plates, all similarly bent into a "U" shaped plate wherein each bent plate has two parallel flat sides connected by a half-hollow-cylinder;

a cylinder with a diameter substantially equal to a distance between the two flat sides of bent plates, wherein the cylinder is kept within the half-hollow-cylinder part of all three bent plates and wherein curved portions of two of the bent plates adjoins same half-cylinder-surface of the cylinder and curved portion of the third bent plate that is between the other two bent plates adjoins other half-cylinder-surface of the cylinder such that one flat side of each of the three bent plates lie in a first plane tangent to one side of the cylinder and another flat side of each of the three bent plates lie in a second plane tangent to an opposite side of the cylinder and wherein the first and the second planes are parallel; and two cover plates, wherein two or more damper units are placed between the two cover plates such that the longitudinal axes of all damper units are in parallel and flat sides of bent plates of each damper unit is attached to its adjacent cover plate.

9. The U-plate damper of claim 8, wherein the plates of the damper units are metal plates.

10. The U-plate damper of claim 8, wherein the three plates of the damper units are made of several layers of same or different metal plates with same or different thicknesses.

11. The U-plate damper of claim 8, wherein the cylinder is solid or hollow.

12. The U-plate damper of claim 8, wherein the attachments of the flat side of the bent plates to the cover plates are fixed attachments and/or moveable attachments.

13. The U-plate damper of claim 12, wherein the cover plates have slotted holes for moveable attachments and wherein attachment pins of some flat sides of some bent plates enter slotted holes of the cover plates and engage the cover plates after the cover plates move relative to each other and wherein lengths of slotted holes determine necessary amount of relative movement of the two cover plates before engagement.

14. The U-plate damper of claim 13, wherein attachments of one side of some damper units to either one of the cover plates are moveable attachments and slotted holes for moveable attachment of different damper units are different or same size so as to engage different damper units in two or more stages.

15. The U-plate damper of claim 8, wherein multiple damper units are arranged in a line formation between the two cover plates.

* * * * *